US008843008B2

(12) United States Patent
Uehara

(10) Patent No.: US 8,843,008 B2
(45) Date of Patent: Sep. 23, 2014

(54) IMAGE FORMING APPARATUS

(71) Applicant: Fuji Xerox Co., Ltd., Tokyo (JP)

(72) Inventor: Taiyo Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 73 days.

(21) Appl. No.: 13/744,787

(22) Filed: Jan. 18, 2013

(65) Prior Publication Data

US 2014/0056605 A1 Feb. 27, 2014

(30) Foreign Application Priority Data

Aug. 24, 2012 (JP) ..... 2012-185039

(51) Int. Cl.

| | |
|---|---|
| ***G03G 15/08*** | (2006.01) |
| ***G03G 15/09*** | (2006.01) |
| ***G03G 15/01*** | (2006.01) |
| ***G03G 15/00*** | (2006.01) |

(52) U.S. Cl.

CPC ..... *G03G 15/0848* (2013.01); *G03G 15/5041* (2013.01); *G03G 15/5058* (2013.01)

USPC ..... 399/49

(58) Field of Classification Search

CPC ..... G03G 15/5033; G03G 15/09; G03G 2215/0609; G03G 15/0921

USPC ..... 399/49, 53, 269, 274, 284

See application file for complete search history.

(56) References Cited

U.S. PATENT DOCUMENTS

| | | | | |
|---|---|---|---|---|
| 2003/0235437 | A1 | 12/2003 | Sakamaki | |
| 2011/0229214 | A1* | 9/2011 | Oba et al. | 399/269 |
| 2011/0229215 | A1* | 9/2011 | Hirota et al. | 399/269 |

FOREIGN PATENT DOCUMENTS

| | | | |
|---|---|---|---|
| JP | 03-168665 | A | 7/1991 |
| JP | 05-080649 | A | 4/1993 |
| JP | 08-146768 | A | 6/1996 |
| JP | 2003-098772 | A | 4/2003 |
| JP | 2004-021125 | A | 1/2004 |

* cited by examiner

*Primary Examiner* — G. M. Hyder
*Assistant Examiner* — Travis Harper
(74) *Attorney, Agent, or Firm* — Sughrue Mion, PLLC

(57) ABSTRACT

An image forming apparatus includes a subjected-to-development member; a first developer-transporting unit; a regulator that regulates the thickness of a developer; a second developer-transporting unit; a density detecting unit that detects center density and edge density of a developed image formed on the subjected-to-development member by the first developer-transporting unit and the second developer-transporting unit; a reference-image forming controller that forms a reference developed image on the subjected-to-development member by forming an electrostatic latent image having a uniform image density at a center position and an edge position; and a speed controller that increases rotation speed of the second developer-transporting unit as compared to the case of forming the reference developed image if the center density of the reference developed image detected by the density detecting unit is lower than the edge density.

2 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2012-185039 filed Aug. 24, 2012.

BACKGROUND

1. Technical Field

The present invention relates to image forming apparatuses.

2. Summary

According to an aspect of the invention, an image forming apparatus includes a subjected-to-development member that rotates and has a surface on which an electrostatic latent image is formed and developed with a developer; a first developer-transporting unit disposed so as to face the subjected-to-development member, the first developer-transporting unit carrying the developer on a circumferential surface thereof and transporting the developer toward the subjected-to-development member while rotating in a first direction in which an opposing area of the first developer-transporting unit that faces a first opposing portion of the subjected-to-development member moves in the same direction as the first opposing portion of the subjected-to-development member; a regulator that regulates the thickness of a layer of the developer carried by the circumferential surface of the first developer-transporting unit, the regulator being disposed upstream from the opposing area of the first developer-transporting unit in the first direction at a distance from the circumferential surface of the first developer-transporting unit; a second developer-transporting unit disposed upstream from the first developer-transporting unit in a direction of rotation of the subjected-to-development member so as to face the subjected-to-development member and downstream from the regulator in the first direction so as to face the first developer-transporting unit, the second developer-transporting unit carrying the developer on a circumferential surface thereof and transporting the developer toward the subjected-to-development member while rotating in a second direction in which an opposing area of the second developer-transporting unit that faces a second opposing portion of the subjected-to-development member moves in a direction opposite to the second opposing portion of the subjected-to-development member; a density detecting unit that detects center density and edge density of a developed image formed on the subjected-to-development member by the first developer-transporting unit and the second developer-transporting unit, the center density being a density of the developed image at or around a center position of the subjected-to-development member in a width direction of the subjected-to-development member that intersects a direction of movement of the surface of the subjected-to-development member, the edge density being a density of the developed image at an edge position of the subjected-to-development member in the width direction of the subjected-to-development member; a reference-image forming controller that forms a reference developed image on the subjected-to-development member by forming an electrostatic latent image having a uniform image density at the center position and the edge position in the width direction and by causing the first developer-transporting unit and the second developer-transporting unit to develop the electrostatic latent image; and a speed controller that increases rotation speed of the second developer-transporting unit as compared to the case of forming the reference developed image if the center density of the reference developed image detected by the density detecting unit is lower than the edge density.

BRIEF DESCRIPTION OF THE DRAWINGS

Exemplary embodiments of the present invention will be described in detail based on the following figures, wherein.

DETAILED DESCRIPTION

Figure 1:
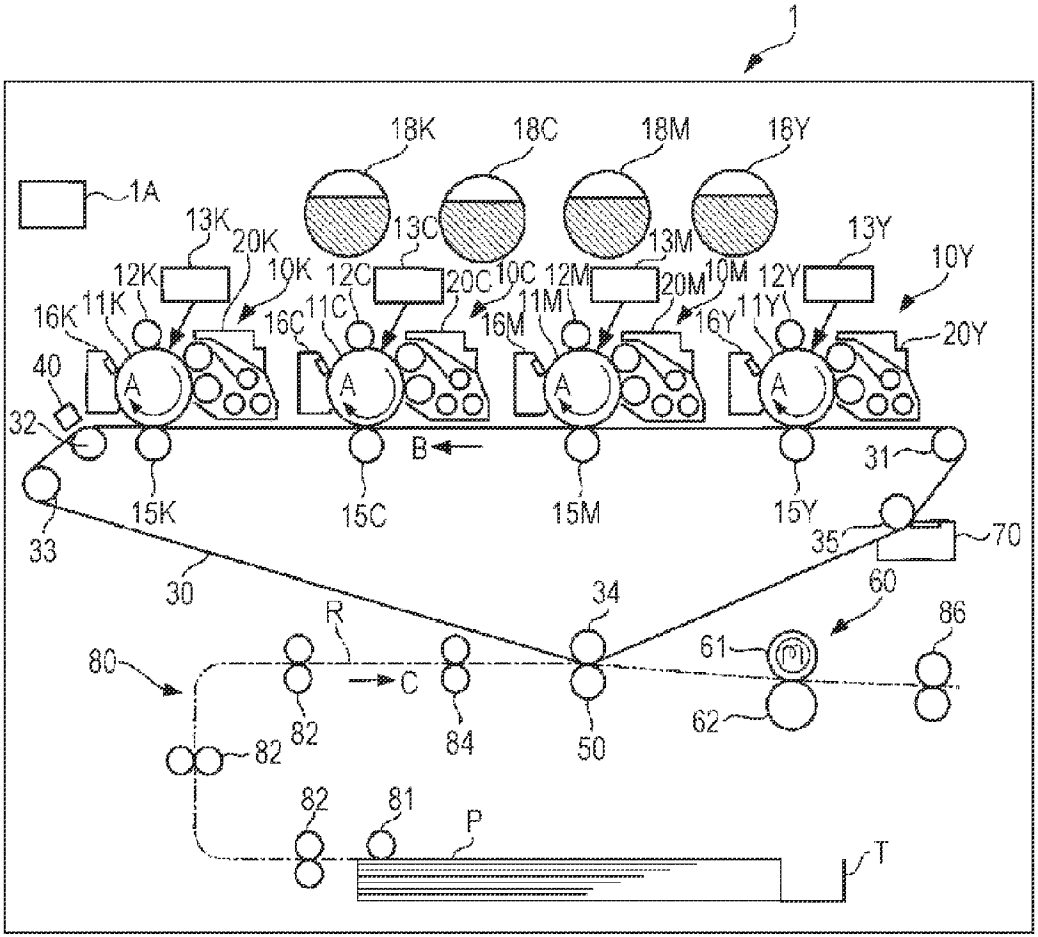
FIG. 1 illustrates a configuration of an image forming apparatus according to a first exemplary embodiment of the invention.

Referring to the drawings, exemplary embodiments of the invention will be described below.

FIG. 1 illustrates a configuration of an image forming apparatus 1 according to a first exemplary embodiment of the invention.

The image forming apparatus 1 illustrated in FIG. 1 is a tandem color printer in which image forming units 10Y, 10M, 10C, and 10K for corresponding colors of yellow (Y), magenta (M), cyan (C), and black (K) are arranged side by side. The image forming apparatus 1 is capable of printing not only a single-color image but also a full-color image constituted by toner images of four colors. Toner cartridges 18Y, 18M, 18C, and 18K respectively contain toners of the colors of Y, M, C, and K.

Since the four image forming units 10Y, 10M, 10C, and 10K have almost the same configuration, the image forming unit 10Y corresponding to yellow (Y) is exemplarily described. The image forming unit 10Y includes a photoconductor drum 11Y, a charging device 12Y, an exposing device 13Y, a developing device 20Y, a first transfer device 15Y, and a photoconductor cleaner 16Y.

The photoconductor drum 11Y is formed by attaching a photoconductor layer to a surface of a cylindrical base. The photoconductor drum 11Y rotates around an axis of the cylindrical base or in a direction of the arrow A while carrying an image on its surface. The charging device 12Y, the exposing device 13Y, the developing device 20Y, the first transfer device 15Y, and the photoconductor cleaner 16Y are arranged around the photoconductor drum 11Y in order in the direction of the arrow A.

The charging device 12Y is a device that charges the surface of the photoconductor drum 11Y. The charging device 12Y is a charging roller that contacts the surface of the photoconductor drum 11Y. A voltage that has the same polarity as that of a toner contained in the developing device 20Y is applied to the charging device 12Y, and the charging device 12Y charges the surface of the photoconductor drum 11Y by contacting it. The exposing device 13Y is a device that emits exposure light to the surface of the photoconductor drum 11Y to expose the surface to light. The exposing device 13Y emits a laser beam based on an image signal supplied from the outside of the image forming apparatus 1 and scans the surface of the photoconductor drum 11Y with the laser beam. The developing device 20Y develops an electrostatic latent image on the surface of the photoconductor drum 11Y with a developer. A toner is supplied from the toner cartridge 18Y to the developing device 20Y. The developing device 20Y agitates a developer containing a magnetic carrier and a toner to charge the toner and the magnetic carrier, and develops the electrostatic latent image on the surface of the photoconductor drum 11Y with the charged toner. The first transfer device 15Y is a roller that faces the photoconductor drum 11Y with an intermediate transfer belt 30 interposed therebetween. When a voltage is applied to the first transfer device 15Y at a portion facing the photoconductor drum 11Y, the first transfer device 15Y transfers a toner image formed on the photoconductor drum 11Y to the intermediate transfer belt 30. The photoconductor cleaner 16Y cleans the surface of the photoconductor drum 11Y by removing remnants such as a toner remaining in a portion of the surface of the photoconductor drum 11Y that has been subjected to the transfer operation by the first transfer device 15Y.

The image forming apparatus 1 also includes the intermediate transfer belt 30, a fixing device 60, a sheet transporting unit 80, and a controller 1A. The intermediate transfer belt 30 is an endless belt stretched around belt supporting rollers 31 to 35. The intermediate transfer belt 30 rotates in a direction of the arrow B via the image forming units 10Y, 10M, 10C, and 10K and a second transfer device 50. Toner images of different colors are transferred from the image forming units 10Y, 10M, 10C, and 10K to the intermediate transfer belt 30. The intermediate transfer belt 30 moves while carrying the toner images of these colors. A density sensor 40 is disposed at such a position as to face a portion of the intermediate transfer belt 30 between the second transfer device 50 and the image forming units 10Y to 10K. The density sensor 40 detects the density of a toner image (developed image) formed on the photoconductor drum 11Y by detecting the density of a toner image transferred to the intermediate transfer belt 30. The density sensor 40 measures center density, which is the density of the image at or around a center position in the width direction of the intermediate transfer belt 30, and edge density, which is the density of the image at or around edge positions in the width direction of the intermediate transfer belt 30. Information on the measured density is supplied to the controller 1A. The density sensor 40 is an example of a density detector in the invention. The controller 1A is an example of a reference-image forming controller of the invention.

The second transfer device 50 is a roller that rotates while nipping the intermediate transfer belt 30 and a sheet P between itself and a back-up roller 34, which is one of the belt supporting rollers 31 to 35. When a voltage having a polarity opposite to that of a toner is applied to the second transfer device 50, the second transfer device 50 transfers the toner image formed on the intermediate transfer belt 30 to a sheet P.

The fixing device 60 is used to fix the toner image to the sheet P. The fixing device 60 includes a heating roller 61 and a compressing roller 62, and the heating roller 61 contains a heating device. The heating roller 61 and the compressing roller 62 cause a sheet P having an unfixed toner image thereon to pass therethrough while nipping the sheet P so that the toner is heated and pressed and the toner image is fixed to the sheet P.

The sheet transporting unit 80 transports the sheets P along a sheet transport path R along which the sheets P pass the second transfer device 50 and the fixing device 60. The sheet transporting unit 80 includes a pick-up roller 81, transporting rollers 82, registration rollers 84, and ejecting rollers 86. The pick-up roller 81 picks up sheets P from the sheet container T. The transporting rollers 82 transport the picked-up sheets P. The registration rollers 84 transport the sheets P to the second transfer device 50. The ejecting rollers 86 eject the sheets P to the outside.

A fundamental operation of the image forming apparatus 1 illustrated in FIG. 1 will be described now. In the image forming unit 10Y corresponding to yellow, the photoconductor drum 11Y rotates in the direction of the arrow A and the surface of the photoconductor drum 11Y is charged by the charging device 12Y. The exposing device 13Y irradiates the surface of the photoconductor drum 11Y with exposure light corresponding to data of the color designated in the image signal. The exposing device 13Y irradiates the surface of the photoconductor drum 11Y with exposure light based on an image signal corresponding to yellow among image signals supplied from the outside in order to form an electrostatic latent image on the surface of the photoconductor drum 11Y. The developing device 20Y receives a supply of a yellow toner from the toner cartridge 18Y and develops the electrostatic latent image formed on the photoconductor drum 11Y with the toner to form a toner image. The photoconductor drum 11Y rotates while carrying the yellow toner image on its surface. The toner image formed on the surface of the photoconductor drum 11Y is transferred to the intermediate transfer belt 30 by the first transfer device 15Y. A toner remaining on the photoconductor drum 11Y after the transfer operation is performed is removed by the photoconductor cleaner 16Y.

The intermediate transfer belt 30 rotates in the direction of the arrow B. Like the image forming unit 10Y, the image forming units 10M, 10C, and 10K for colors other than yellow form toner images of the corresponding colors and transfer the toner images to the intermediate transfer belt 30 such that the toner images are superposed on the toner image that has been transferred by the image forming unit 10Y.

The pick-up roller 81 picks up a sheet P from the sheet container T. The transporting rollers 82 and the registration rollers 84 transport the sheet P in the direction of the arrow C along the sheet transport path R toward the second transfer device 50. The registration rollers 84 feed the sheet P to the second transfer device 50 on the basis of the time when the toner images are transferred to the intermediate transfer belt 30. The second transfer device 50 transfers the toner images on the intermediate transfer belt 30 to the sheet P. The sheet P to which the toner images have been transferred is transported from the second transfer device 50 to the fixing device 60 and there the toner images on the sheet P are fixed to the sheet P. In this manner, an image is formed on the sheet P. The sheet P having the image thereon is ejected by the ejecting rollers 86 to the outside of the image forming apparatus 1. A toner remaining on the intermediate transfer belt 30 after the transfer operation of the second transfer device 50 is performed is removed by a belt cleaner 70.

Developing Device

Figure 2:
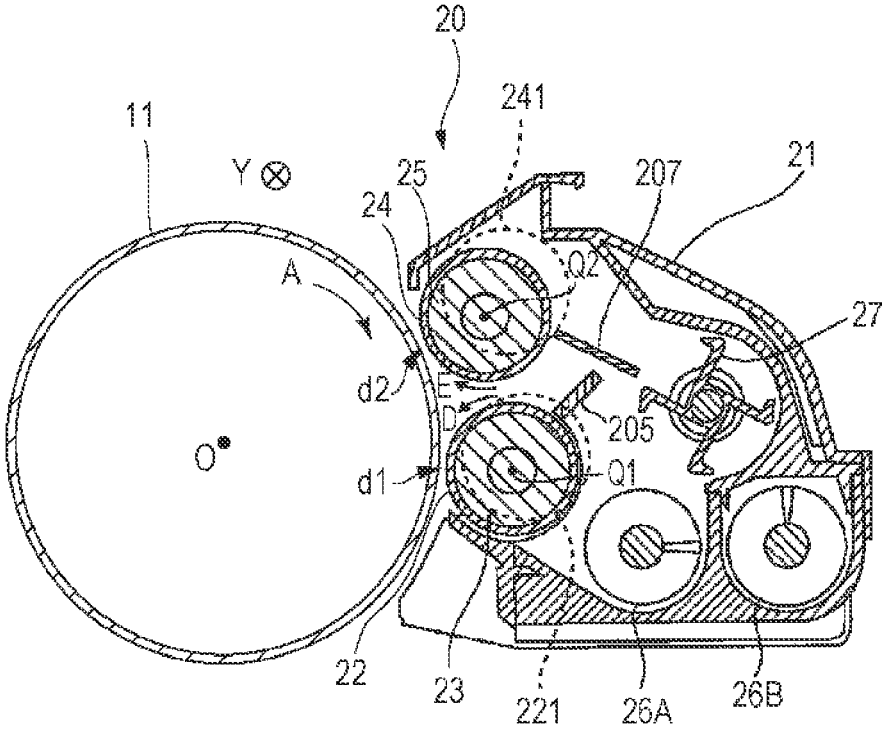
FIG. 2 illustrates a configuration a developing device illustrated in FIG. 1 in cross section.

FIG. 2 illustrates a configuration of the developing device illustrated in FIG. 1 in cross section. Since the developing devices 20Y to 20K for different colors illustrated in FIG. 1 have the same configuration, they are collectively described as a developing device 20 here.

The developing device 20 includes a container 21, a downstream roller 22, a first magnet 23, an upstream roller 24, a second magnet 25, a first agitating member 26A, a second agitating member 26B, and a paddling member 27. The downstream roller 22 is an example of a first developer-transporting member in the invention and the upstream roller 24 is an example of a second developer-transporting member in the invention.

The container 21 contains a developer and supports the components of the developing device 20.

The first agitating member 26A and the second agitating member 26B agitate the developer contained in the container 21. The first agitating member 26A and the second agitating member 26B extend in the width direction Y that intersects the direction in which the surface of the photoconductor drum 11 moves. The first agitating member 26A and the second agitating member 26B have a structure in which a helical blade is helically formed on the rotation shaft. The first agitating member 26A and the second agitating member 26B are arranged so as to be adjacent to each other, and the first agitating member 26A is located adjacent to the downstream roller 22. The first agitating member 26A and the second agitating member 26B transport the developer in opposite directions in the width direction Y by rotating. The developer is circulated in the container 21 while being agitated by the first agitating member 26A and the second agitating member 26B. The toner and the magnetic carrier in the developer become charged by being agitated so as to have opposite polarities. The toner becomes negatively charged and the magnetic carrier becomes positively charged.

The downstream roller 22 and the upstream roller 24 are cylindrical development rollers extending in the width direction Y and are disposed so as to face the photoconductor drum 11. The downstream roller 22 and the upstream roller 24 are individually driven by two motors 221 and 241. The two motors 221 and 241 are controlled by the controller 1A independently of each other. The controller 1A synchronously drives and stops the downstream roller 22 and the upstream roller 24, but drives the rollers 22 and 24 at different rotation speeds independently of each other. The first agitating member 26A, the second agitating member 26B, and the paddling member 27 are driven by the motor 221 that drives the downstream roller 22. The upstream roller 24 is disposed upstream from the downstream roller 22 in the arrow A direction in which the photoconductor drum 11 rotates. The first magnet 23 is located inside the downstream roller 22 and thus attracts the developer to the downstream roller 22. The second magnet 25 is located inside the upstream roller 24 and thus attracts the developer to the upstream roller 24. The first magnet 23 has multiple magnetic poles that are arranged in the circumferential direction of the downstream roller 22. The second magnet 25 also has multiple magnetic poles that are arranged in the circumferential direction of the upstream roller 24.

The downstream roller 22 and the upstream roller 24 support the developer on their circumferential surfaces to transport the developer to the photoconductor drum 11 while rotating.

The downstream roller 22 rotates in a direction in which a portion of the downstream roller 22 facing a first opposing portion of the photoconductor drum 11 in a first development area d1 moves in the same direction as the first opposing portion of the photoconductor drum 11 (in the direction of the arrow D or the "with direction" relative to the movement of the photoconductor drum 11). The upstream roller 24 rotates in a direction in which a portion of the upstream roller 24 facing a second opposing portion of the photoconductor drum 11 in a second development area d2 moves in a direction opposite to the second opposing portion of the photoconductor drum 11 (in the direction of the arrow E or the "against direction" relative to the movement of the photoconductor drum 11). Accordingly, the downstream roller 22 and the upstream roller 24 rotate such that portions of their circumferential surfaces facing each other move in substantially the same direction.

A thickness regulating member 205 is a plate member. The thickness regulating member 205 is disposed upstream from the first development area d1 of the downstream roller 22 in the direction of the arrow D at a distance from the downstream roller 22. The thickness regulating member 205 regulates the thickness of a layer of the developer carried by the circumferential surface of the downstream roller 22.

The developer is carried by the downstream roller 22 and moves in the direction of the arrow D in which the downstream roller 22 rotates. The thickness of a layer of the developer on the downstream roller 22 is regulated by the thickness regulating member 205. The developer is attracted by the magnetic force of the first magnet 23 and the second magnet 25 in an area in which the downstream roller 22 and the upstream roller 24 face each other and part of the developer is allocated to the upstream roller 24. The developer allocated to the upstream roller 24 is transported toward a portion of the photoconductor drum 11 in the second development area d2 by the upstream roller 24. The developer remaining on the downstream roller 22 is transported toward a portion of the photoconductor drum 11 in the first development area d1.

The photoconductor drum 11 comes into contact with the developer twice, i.e., in the second development area d2 and the first development area d1. When the toner in the developer adheres to the electrostatic latent image formed on the photoconductor drum 11, a toner image is formed. Part of the developer that remains on the downstream roller 22 without adhering to the photoconductor drum 11 in the first development area d1 is transported by the downstream roller 22 back to the first agitating member 26A. Part of the developer that remains on the upstream roller 24 without adhering to the photoconductor drum 11 in the second development area d2 is transported by the upstream roller 24, moves over a guide board 207, and is guided to the paddling member 27. The paddling member 27 has a rotation shaft and paddle plates. The paddle plates are attached to the rotation shaft, extending in the width direction Y, such that the paddle plates stand on the shaft. The developer is agitated by the paddling member 27 and returned to the first agitating member 26A.

The circumferential surface of the upstream roller 24 moves in such a direction as to resist the movement of the circumferential surface of the photoconductor drum 11. Thus, the upstream roller 24 has a higher development capability than the downstream roller 22 whose circumferential surface moves in such a direction as to facilitate movement of the circumferential surface of the photoconductor drum 11. When the developer that is transported while being carried by the upstream roller 24 passes through a second development area d2, that is, a narrow gap between the upstream roller 24 and the photoconductor drum 11, the developer receives pressure. Here, the magnitude of pressure depends on the amount of developer transported by the upstream roller 24 and the size of the gap. If the pressure on the developer is sufficiently high as to damage the developed image on the circumferential surface of the photoconductor drum 11 that has been developed by the upstream roller 24, a defect occurs on the toner image formed by being developed by the developing device 20. Examples of the image (toner image) defect caused by the high pressure on the developer include blur or a low density portion (a portion having a small amount of toner per unit area). Since the circumferential surface of the upstream roller 24 moves in such a direction as to resist the movement of the circumferential surface of the photoconductor drum 11, the upstream roller 24 has a higher development capability but is responsible for a larger proportion of image defects due to the high pressure on the developer than the downstream roller 22.

The magnitude of pressure on the developer depends on the size of the gap between the upstream roller 24 and the photoconductor drum 11. Thus, both ends of a rotation shaft Q2 of the upstream roller 24 in the width direction Y are supported at such positions as to be substantially equidistant from the rotation center O of the photoconductor drum 11. Nevertheless, the distance between the upstream roller 24 and the photoconductor drum 11 varies in the width direction Y.

Figure 3:
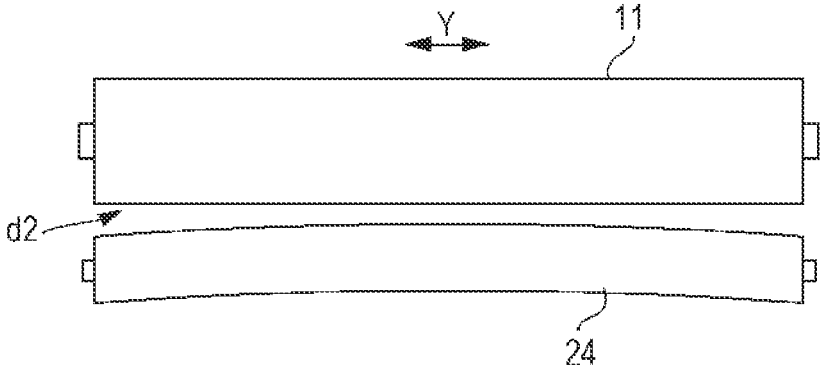
FIG. 3 is a plan view schematically illustrating the positional relationship between an upstream roller and a photoconductor drum.

FIG. 3 is a plan view schematically illustrating the positional relationship between the upstream roller 24 and the photoconductor drum 11.

A force toward the photoconductor drum 11 acts on the upstream roller 24. This force is attributable to forces such as the magnetic force of the second magnet 25 inside the upstream roller 24, the magnetic force of the developer on the circumferential surface of the upstream roller 24, and pressure of the developer inside the container 21. This force deforms the upstream roller 24 such that a center portion of the upstream roller 24 in the width direction Y is displaced toward the photoconductor drum 11. FIG. 3 illustrates the deformation of the upstream roller 24 in an exaggerated way. Because of the deformation of the upstream roller 24, the pressure on the developer transported to the second development area d2 by being carried by the upstream roller 24 is made larger in the center portion of the upstream roller 24 in the width direction Y than in edge portions of the upstream roller 24 in the width direction Y. Consequently, image defects such as blur or a low density portion are more likely to appear in the center portion than in the edge portions in the width direction Y of the image.

In the image forming apparatus 1 according to the exemplary embodiment, the upstream roller 24 adjusts the amount of developer to be supplied to the photoconductor drum 11 on the basis of the density of the formed image (toner image).

Figure 4:
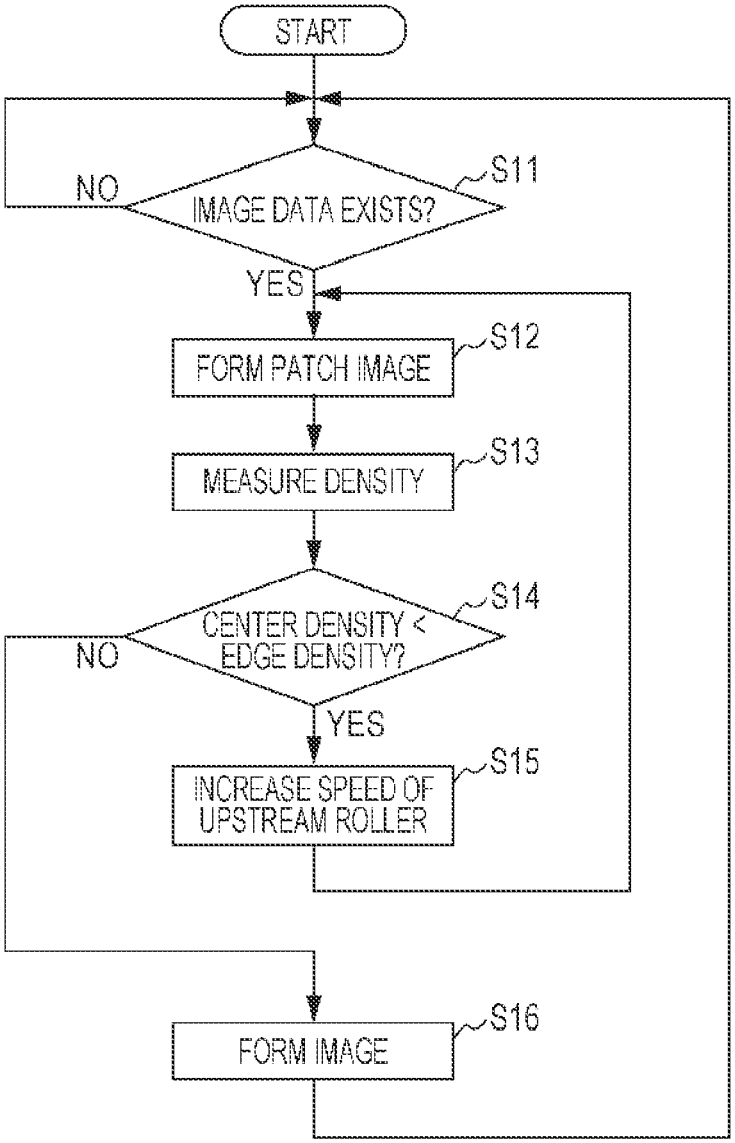
FIG. 4 is a flowchart illustrating operations of the image forming apparatus illustrated in FIG. 1.

FIG. 4 is a flowchart illustrating operations of the image forming apparatus illustrated in FIG. 1.

Each component of the image forming apparatus 1 is controlled by the controller 1A. When image data is supplied from the outside of the image forming apparatus 1 (Yes in Step S11), the controller 1A causes the image forming units 10Y to 10K to form a patch image, which is a reference developed image (Step S12). The controller 1A that performs the operation in Step S12 is an example of a reference-image forming controller of the invention.

Figure 5:
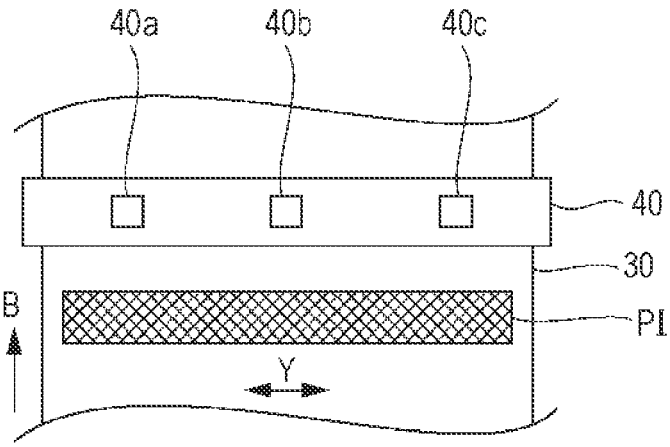
FIG. 5 is a plan view of an intermediate transfer belt to which a patch image has been transferred.

FIG. 5 is a plan view of the intermediate transfer belt 30 to which a patch image PI has been transferred.

The patch image PI extends from one edge portion to another edge portion through the center portion in the width direction Y of the intermediate transfer belt 30. As an example, the case where a yellow patch image is formed is described. In order to form the patch image PI, first, the controller 1A causes the charging device 12Y and the exposing device 13Y of the image forming unit 10Y to form an electrostatic latent image, which becomes a base of the patch image PI, on the photoconductor drum 11Y. The electrostatic latent image formed here has a uniform density at the center and edge positions in the width direction Y of the photoconductor drum 11Y. Subsequently, the controller 1A causes the upstream roller 24 and the downstream roller 22 of the developing device 20Y to develop the electrostatic latent image. With this development, a patch image, which is a toner image, is formed. Thereafter, the controller 1A causes the first transfer device 15Y to transfer the patch image from the photoconductor drum 11Y to the intermediate transfer belt 30. In this manner, the patch image illustrated in FIG. 5 is transferred to the intermediate transfer belt 30.

After the patch image is formed in Step S12, the controller 1A measures the density of the patch image (Step S13). As illustrated in FIG. 5, the density sensor 40 includes a sensor 40*b*, which is disposed at the center position in the width direction Y of the intermediate transfer belt 30, and sensors 40*a* and 40*c*, which are disposed at the edge positions in the width direction Y of the intermediate transfer belt 30. The controller 1A causes the sensors 40*a*, 40*b*, and 40*c* to measure the density of the patch image at the center position (center density) and the edge positions (edge density). The edge density is determined by averaging the measurement results of the two sensors 40*a* and 40*c* located at the edge positions.

When the center density is lower than the edge density (Yes in Step S14), the controller 1A determines that an excessive pressure is applied to the developer at the center position in the width direction Y, at which the distance between the photoconductor drum 11 and the upstream roller 24 is small, in the second development area d2 between the upstream roller 24 and the photoconductor drum 11. In this case, the controller 1A controls the motor 241 to increase the rotation speed of the upstream roller 24 (the number of rotations per unit time) (Step S15). In the exemplary embodiment, the rotation speed of the upstream roller 24 is increased while the rotation speed of the downstream roller 22 remains unchanged.

The thickness of a layer of the developer that is transported while being carried by the circumferential surface of the downstream roller 22 is regulated by the thickness regulating member 205. Thus, the amount of developer carried on a portion of the circumferential surface of the downstream roller 22 and that has just passed by the thickness regulating member 205 does not depend on the rotation speed of the downstream roller 22. Here, the amount of developer is not the amount of developer that the roller 22 or 24 transports when passing a certain area per unit time, but the amount of developer that exists in a certain area of the roller 22 or 24 at a certain time point. In other words, the amount of developer is the amount that depends on the thickness of the layer of the developer.

Part of the developer that has passed by the thickness regulating member 205 is transferred from the downstream roller 22 to the upstream roller 24 and is transported to an area between the upstream roller 24 and the photoconductor drum 11. The ratio of the amount of developer allocated to the upstream roller 24 to the amount of developer transported on the downstream roller 22 (not the ratio in terms of the thickness of the layer, but the ratio in terms of the amount per unit time) is determined by the magnetic forces of the first magnet 23 and the second magnet 25. Thus, the rotation speed affects the ratio between the allocated amounts less than the magnetic force does. The amount (the thickness) of developer transported by the upstream roller 24 in the second development area d2 between the upstream roller 24 and the photoconductor drum 11 decreases as the rotation speed of the upstream roller 24 increases. When the amount of developer transported by the upstream roller 24 decreases, the pressure on the developer in the second development area d2 that has been excessive decreases. The controller 1A that performs the operations in Steps S13 to S15 is an example of a speed controller in the invention.

After the operation in Step S15 is performed, the processing returns to Step 12 in which the controller 1A forms a patch image. Although the flowchart of FIG. 4 omits redundant illustration of the operations for each color, the operations in Steps S12 to S14 are performed independently for each of the image forming units 10Y, 10M, 10C, and 10K. After the density of the patch image is measured (Step S13), if the center density is higher than or equal to the edge density (No in Step S14), an image is formed on the basis of the supplied image data (Step S16).

In the image forming apparatus 1 according to the exemplary embodiment, when the measurement results of the patch image show that the center density is lower than the edge density, the rotation speed of the upstream roller 24 is made higher than that in the case of forming the patch image. Consequently, the pressure on the developer in the second development area d2 that has been excessive decreases. Thus, image defects attributable to the excessive pressure on the developer are less likely to occur.

Second Exemplary Embodiment

Now, a second exemplary embodiment of the present invention will be described. In the following description of the second exemplary embodiment, components that are the same as the components according to the above-described first exemplary embodiment are denoted by the same reference symbols and points at which the second exemplary embodiment differs from the first exemplary embodiment will be described.

Figure 6:
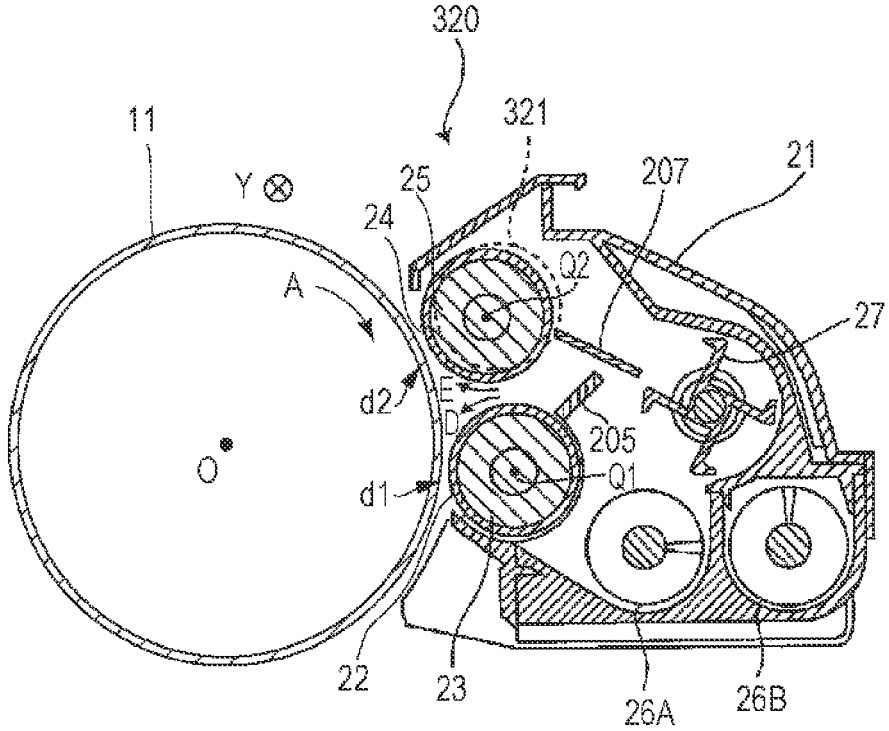
FIG. 6 illustrates a configuration of a developing device according to a second exemplary embodiment in cross section.

FIG. 6 illustrates a configuration of a developing device according to the second exemplary embodiment in cross section.

In the developing device 320 illustrated in FIG. 6, one motor 321 drives both the downstream roller 22 and the upstream roller 24. More specifically, the downstream roller 22 and the upstream roller 24 are connected to each other via gears, which are not illustrated, and the upstream roller 24 rotates in conjunction with the downstream roller 22. The downstream roller 22 and the upstream roller 24 are set so as to rotate at substantially the same rotation speed.

The image forming apparatus according to the exemplary embodiment operates in accordance with the flowchart of the first exemplary embodiment illustrated in FIG. 4. However, unlike in Step S15 according to the first exemplary embodiment in which the rotation speed of the upstream roller 24 is increased while the rotation speed of the downstream roller 22 remains unchanged, the rotation speed of the downstream roller 22 is increased as the rotation speed of the upstream roller 24 is increased in Step S15 according to the second exemplary embodiment.

The thickness of a layer of the developer transported while being carried by the circumferential surface of the downstream roller 22 is regulated by the thickness regulating member 205 and does not depend on the rotation speed of the downstream roller 22. The ratio of the amount of developer allocated to the upstream roller 24 to the amount of developer transported on the downstream roller 22 (not the ratio in terms of the thickness of the layer, but the ratio in terms of the amount per unit time) is determined by the magnetic forces of the first magnet 23 and the second magnet 25. Thus, the amount (thickness) of developer that has been allocated from the downstream roller 22 so as to be transported by the upstream roller 24 decreases as the rotation speed of the upstream roller 24 increases. When the amount of developer transported by the upstream roller 24 decreases, the pressure on the developer in the second development area d2 that has been excessive decreases. Thus, image defects attributable to the excessive pressure on the developer are less likely to occur.

In the image forming apparatus according to the exemplary embodiment, the rotation speed of the downstream roller 22 is increased as the rotation speed of the upstream roller 24 is increased. The motor 321 is used as a driving source shared by both the downstream roller 22 and the upstream roller 24. Thus, the image forming apparatus according to the exemplary embodiment has a smaller number of components than in the case of the configuration that includes separate driving sources for the downstream roller 22 and the upstream roller 24.

In the above-described exemplary embodiments, after the rotation speed of the upstream roller 24 is increased (Step S15), the processing returns to Step 12 and the controller 1A causes each image forming unit to form a patch image. However, an image forming apparatus in the invention may be an apparatus that increases the rotation speed of the second developer-transporting unit and then forms an image based on image data without forming a reference developed image.

In the above-described exemplary embodiments, the controller 1A is described as being one that increases the rotation speed of the upstream roller 24. However, a speed controller in the invention may reset the speed that has been increased to an initial speed at the time, for example, when the power is turned on or off.

In the above-described exemplary embodiments, as an example of a density detecting unit in the invention, the density sensor 40 is described as being one that is disposed at such a position as to face a portion of the intermediate transfer belt 30 between the second transfer device 50 and the image forming units 10Y to 10K. The present invention, however, is not limited to this. The density detecting unit may be one that measures, for example, the density of a developed image on a subjected-to-development member.

In the above-described exemplary embodiments, as an example of a speed controller in the invention, the controller 1A is described as being one that increases the rotation speed of the upstream roller 24 and then forms a patch image again. The present invention, however, is not limited to this. For example, the speed controller may increase the rotation speed of the second developer-transporting unit and then form an image on the basis of image data.

In the above-described exemplary embodiments, a tandem color printer is illustrated as an example of an image forming apparatus. The image forming apparatus in the invention, however, is not limited to this, and may be, for example, a single-color printer that does not include an intermediate transfer belt.

In the above-described exemplary embodiments, a printer is illustrated as an exemplary image forming apparatus. The image forming apparatus in the invention, however, is not limited to a printer, and may be, for example, a copying machine or a fax machine.

In the above-described exemplary embodiments, a configuration that includes a charging roller and a laser exposing device is illustrated as an example of an image forming unit in the invention. The image forming unit in the invention, however, is not limited to this, and may include, for example, a corona discharge device such as a corotron or scorotron instead of the charging roller or may include an array of multiple light emitting diodes instead of the laser exposing device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a subjected-to-development member that rotates and has a surface on which an electrostatic latent image is formed and developed with a developer;

a first developer-transporting unit disposed so as to face the subjected-to-development member, the first developer-transporting unit carrying the developer on a circumferential surface thereof and transporting the developer toward the subjected-to-development member while rotating in a first direction in which an opposing area of the first developer-transporting unit that faces a first opposing portion of the subjected-to-development member moves in the same direction as the first opposing portion of the subjected-to-development member;

a regulator that regulates the thickness of a layer of the developer carried by the circumferential surface of the first developer-transporting unit, the regulator being disposed upstream from the opposing area of the first developer-transporting unit in the first direction at a distance from the circumferential surface of the first developer-transporting unit;

a second developer-transporting unit disposed upstream from the first developer-transporting unit in a direction of rotation of the subjected-to-development member so as to face the subjected-to-development member and downstream from the regulator in the first direction so as to face the first developer-transporting unit, the second developer-transporting unit carrying the developer on a circumferential surface thereof and transporting the developer toward the subjected-to-development member while rotating in a second direction in which an opposing area of the second developer-transporting unit that faces a second opposing portion of the subjected-to-development member moves in a direction opposite to the second opposing portion of the subjected-to-development member;

a density detecting unit that detects center density and edge density of a developed image formed on the subjected-to-development member by the first developer-transporting unit and the second developer-transporting unit, the center density being a density of the developed image at or around a center position of the subjected-to-development member in a width direction of the subjected-to-development member that intersects a direction of movement of the surface of the subjected-to-development member, the edge density being a density of the developed image at an edge position of the subjected-to-development member in the width direction of the subjected-to-development member;

a reference-image forming controller that forms a reference developed image on the subjected-to-development member by forming an electrostatic latent image having a uniform image density at the center position and the edge position in the width direction and by causing the first developer-transporting unit and the second developer-transporting unit to develop the electrostatic latent image; and a speed controller that increases rotation speed of the second developer-transporting unit as compared to the case of forming the reference developed image if the center density of the reference developed image detected by the density detecting unit is lower than the edge density.

2. The image forming apparatus according to claim 1, wherein the speed controller increases rotation speed of the first developer-transporting unit in conjunction with an increase in rotation speed of the second developer-transporting unit.

* * * * *